US011208278B2

(12) United States Patent
Nguyen

(10) Patent No.: US 11,208,278 B2
(45) Date of Patent: Dec. 28, 2021

(54) SHEET FEED DEVICE AND IMAGE FORMING APPARATUS

(71) Applicant: KYOCERA Document Solutions Inc., Osaka (JP)

(72) Inventor: Danh Chien Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 155 days.

(21) Appl. No.: 16/560,526

(22) Filed: Sep. 4, 2019

(65) Prior Publication Data

US 2020/0081388 A1 Mar. 12, 2020

(30) Foreign Application Priority Data

Sep. 12, 2018 (JP) ..... JP2018-170238

(51) Int. Cl.
*B65H 1/26* (2006.01)
*G03G 15/00* (2006.01)
(Continued)

(52) U.S. Cl.
CPC ..... *B65H 1/266* (2013.01); *B65H 1/04* (2013.01); *B65H 3/06* (2013.01); *B65H 5/06* (2013.01); *G03G 15/6511* (2013.01); *B65H 2404/65* (2013.01); *B65H 2404/74* (2013.01); *B65H 2405/114* (2013.01); *B65H 2511/12* (2013.01)

(58) Field of Classification Search
CPC . B65H 1/04; B65H 1/266; B65H 9/00; B65H 2404/60; B65H 2404/61; B65H 2404/63; B65H 2404/65; B65H 2404/721; B65H 2404/722; B65H 2404/74; B65H 2404/741; B65H 2404/7414; B65H 2404/743; B65H 2405/114; B65H 2405/11425; B65H 2405/1144; B65H 2511/12
See application file for complete search history.

(56) References Cited

U.S. PATENT DOCUMENTS

2002/0017754 A1* 2/2002 Kang ..... B65H 31/02 271/223
2006/0082044 A1* 4/2006 Aida ..... B65H 1/04 271/145
(Continued)

FOREIGN PATENT DOCUMENTS

JP 2014218312 A 11/2014

*Primary Examiner* — Prasad V Gokhale
(74) *Attorney, Agent, or Firm* — Alleman Hall Creasman & Tuttle LLP

(57) ABSTRACT

A sheet feed device includes a sheet storage portion, a first regulation portion, a feed portion, and a second regulation portion. The sheet storage portion is attached to an apparatus main body in a detachable manner. A sheet is stored in the sheet storage portion. The first regulation portion stands on a bottom surface of the sheet storage portion and regulates a position of the sheet in a predetermined width direction by externally abutting on a first side of the sheet in the width direction. The feed portion is provided in the apparatus main body and feeds the sheet in a feed direction perpendicular to the width direction. The second regulation portion is provided in the apparatus main body and regulates a position of the sheet by externally abutting on the first side at a downstream of the first regulation portion in the feed direction.

5 Claims, 15 Drawing Sheets

(51) Int. Cl.

| | |
|---|---|
| ***B65H 1/04*** | (2006.01) |
| ***B65H 5/06*** | (2006.01) |
| ***B65H 3/06*** | (2006.01) |

(56) References Cited

U.S. PATENT DOCUMENTS

| | | | | |
|---|---|---|---|---|
| 2007/0090587 | A1* | 4/2007 | Yang | B65H 9/06 271/113 |
| 2016/0221771 | A1* | 8/2016 | Matsushima | B65H 1/266 |
| 2020/0310320 | A1* | 10/2020 | Nakata | B65H 3/0684 |

* cited by examiner

SHEET FEED DEVICE AND IMAGE FORMING APPARATUS

INCORPORATION BY REFERENCE

This application is based upon and claims the benefit of priority from the corresponding Japanese Patent Application No. 2018-170238 filed on Sep. 12, 2018, the entire contents of which are incorporated herein by reference.

BACKGROUND

The present disclosure relates to a sheet feed device for preventing a skew from being generated in a sheet fed in a feed direction, and relates to an image forming apparatus including the sheet feed device.

In general, an image forming apparatus includes a feed portion that includes a pickup roller. The feed portion feeds sheets one by one in a feed direction from a storage portion such as a feed cassette. During this process, what is called a skew may be generated. The skew is a phenomenon in which a sheet in conveyance is skewed with respect to the feed direction.

There is known a conventional image forming apparatus configured to correct the skew. In the conventional image forming apparatus, each sheet is fed by a spherical pickup roller from a sheet storage portion in a feed direction. In addition, a plurality of stoppers aligned in a direction perpendicular to the feed direction are provided on the feed direction side from the pickup roller so that a plurality of portions of a leading end of the sheet can abut on the plurality of stoppers. If a skew is generated in the sheet fed in the feed direction, the leading end of the sheet first abuts on one of the plurality of stoppers. Thereafter, the sheet starts rotating in a plane parallel to the sheet around a position where the sheet has abutted on the pickup roller. Thereafter, the leading end of the sheet abuts on the plurality of stoppers. This allows the skew to be corrected. Subsequently, the plurality of stoppers are retreated from a conveyance path of the sheet, and the sheet is further conveyed in the feed direction.

SUMMARY

A sheet feed device according to an aspect of the present disclosure includes a sheet storage portion, a first regulation portion, a feed portion, and a second regulation portion. The sheet storage portion is attached to an apparatus main body in a detachable manner. A sheet is stored in the sheet storage portion. The first regulation portion standing on a bottom surface of the sheet storage portion and regulates a position of the sheet in a predetermined width direction by externally abutting on a first side of the sheet in the width direction. The feed portion is provided in the apparatus main body and feeds the sheet in a feed direction perpendicular to the width direction. The second regulation portion is provided in the apparatus main body and regulates a position of the sheet in the width direction by externally abutting on the first side of the sheet in the width direction at a downstream of the first regulation portion in the feed direction.

An image forming apparatus according to another aspect of the present disclosure includes the sheet feed device and an image forming portion. The image forming portion forms an image on the sheet fed by the sheet feed device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
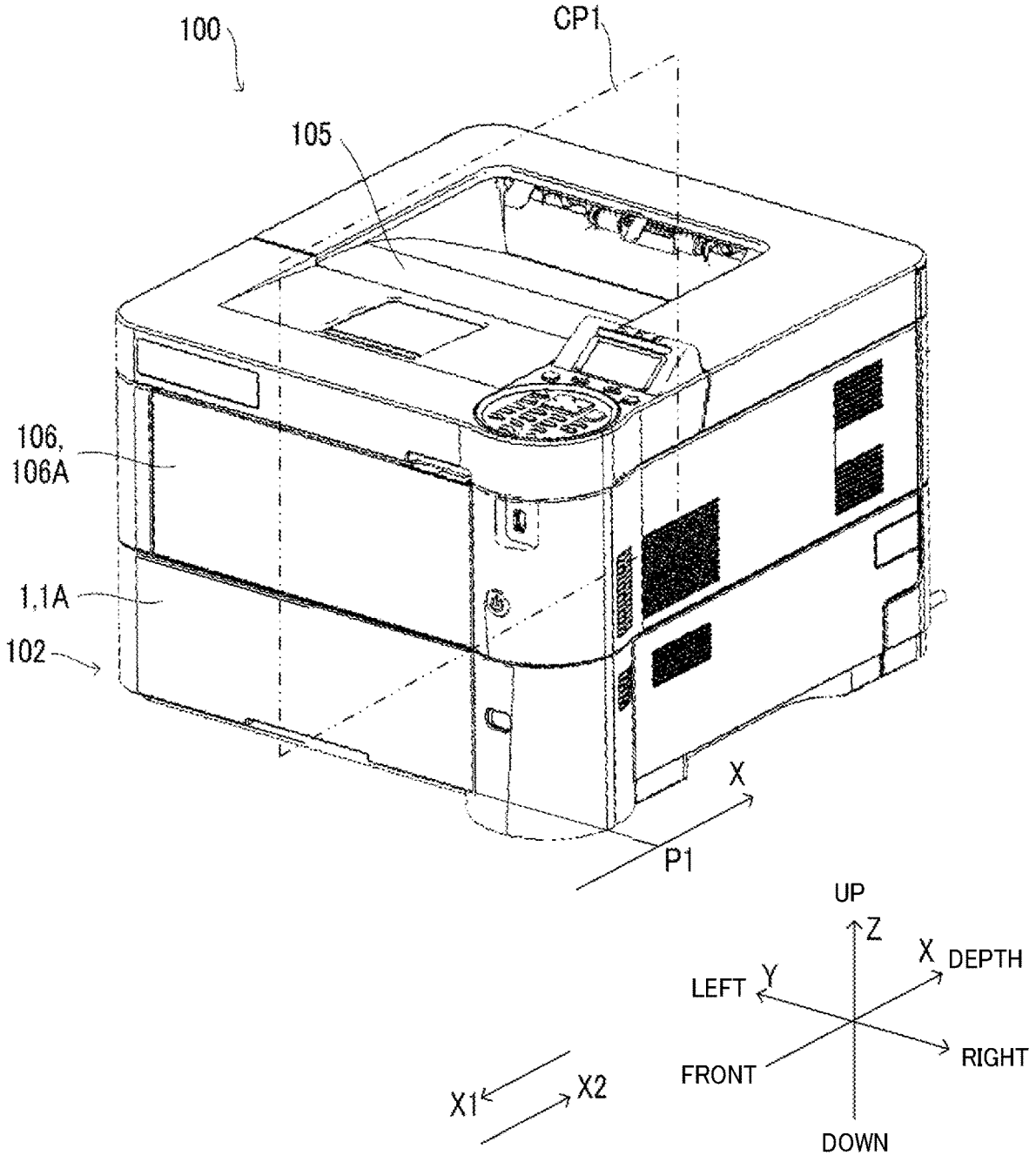
FIG. 1 is a schematic diagram showing an outer appearance of an image forming apparatus according to an embodiment of the present disclosure.

Referring to FIG. 1, the arrow X indicates a depth direction of an image forming apparatus 100, namely a direction directed from the front side to the depth side of the image forming apparatus 100. The arrow Y indicates a width direction, namely, a left-right direction, of the image forming apparatus 100. The width direction is perpendicular to the depth direction. The arrow Z indicates a height direction, namely, a direction directed from the bottom to the top of the image forming apparatus 100. The height direction is perpendicular to the depth direction and the width direction. Hereinafter, the depth direction, the width direction, and the height direction are respectively referred to as a depth direction X, a width direction Y, and a height direction Z.

In addition, in the following description, a ZX plane refers to a plane that is parallel to the height direction Z and the depth direction X. A center plane CP1 is an imaginary plane that passes through a center between regulation plates 3L and 3R (see FIG. 3A) in the width direction Y and is parallel to the ZX plane, wherein the regulation plates 3L and 3R are provided on a bottom portion 1B (see FIG. 3A and FIG. 3B) of a sheet storage portion 1.

Referring to FIG. 1, the image forming apparatus 100 is a printer, a copier, or a multifunction peripheral. The multifunction peripheral includes a plurality of functions such as a print function, a copy function, and a facsimile function. The image forming apparatus 100 performs a print process.

Figure 2:
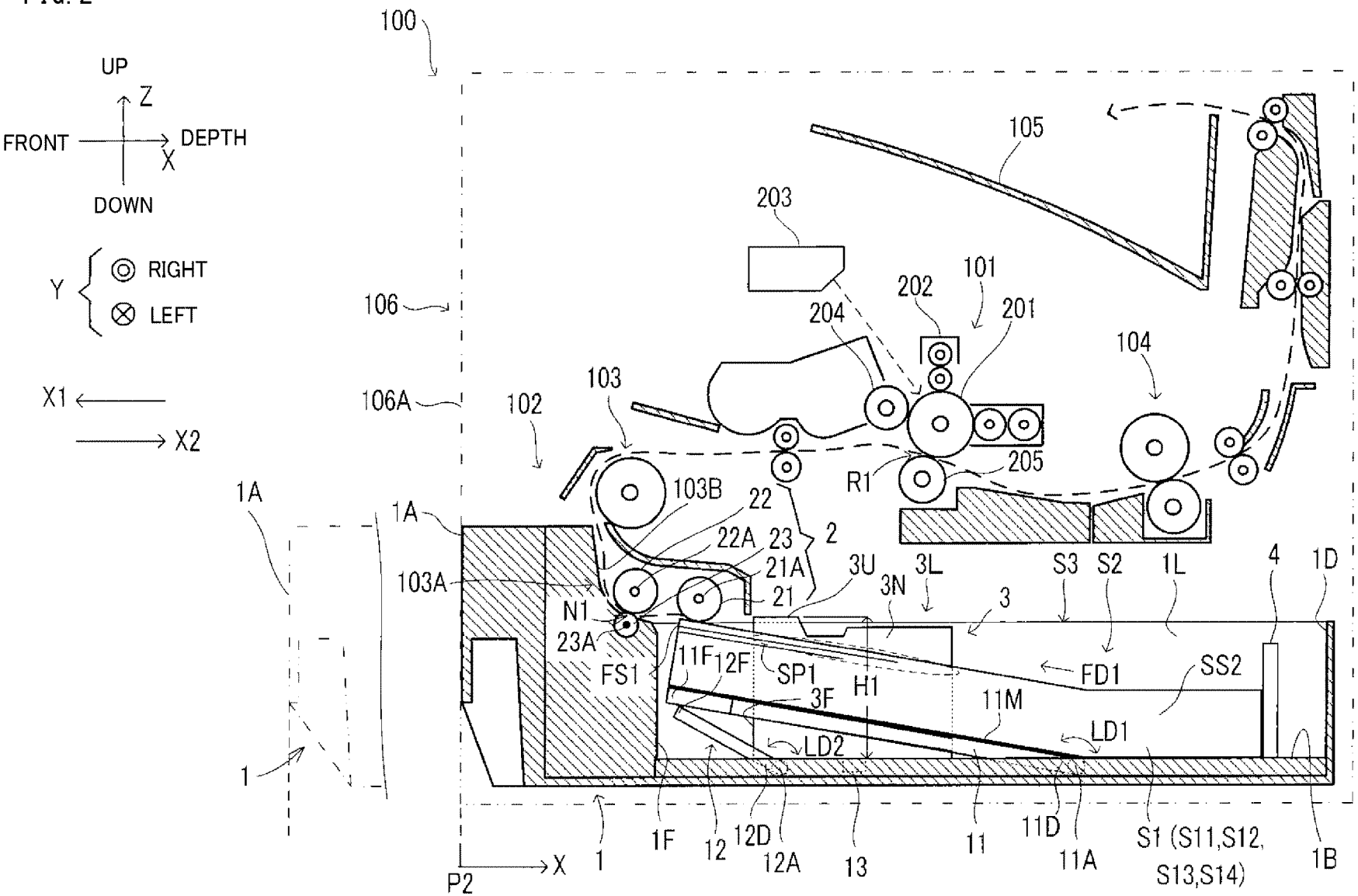
FIG. 2 is a schematic cross section of the image forming apparatus taken along a center plane shown in FIG. 1, showing an inner configuration of the image forming apparatus.

Specifically, the image forming apparatus 100 is an example of an apparatus main body of the present disclosure. As shown in FIG. 2, the image forming apparatus 100 includes an image forming portion 101, a sheet feed device 102, a conveyance path 103, a fixing portion 104, a discharge portion 105, and a housing 106. The sheet feed device 102 includes the sheet storage portion 1, a feed portion 2, a first regulation portion 3, a rear end regulation portion 4, and a second regulation portion 5 (see FIG. 5).

The image forming portion 101 is provided in the housing 106, above the sheet storage portion 1 and below the discharge portion 105. The image forming portion 101 includes an image carrier 201, a charging portion 202, an exposure portion 203, a developing portion 204, and a transfer portion 205. The image carrier 201 is, for example, a photoconductor drum of a cylindrical shape. The image carrier 201 is supported by the housing 106 so as to be rotatable around a shaft center of the image carrier 201 itself. A toner image is formed on the image carrier 201 by an electrophotographic method, by the charging portion 202, the exposure portion 203, and the developing portion 204. As the image carrier 201 rotates, the toner image is conveyed to a transfer region R1. The transfer region R1 is a region of the image carrier 201 that faces the transfer portion 205.

Referring to FIG. 2, the sheet storage portion 1 is attached, in a detachable manner, to the housing 106 of the image forming apparatus 100. Specifically, the sheet storage portion 1 can be drawn out from the housing 106 in a draw-out direction X1, for supply of sheets S1. After the supply of the sheets S1, the sheet storage portion 1 are pushed in, in an insertion direction X2, until a front panel 1A of the sheet storage portion 1 reaches a predetermined attachment position P2. The insertion direction X2 is opposite to the draw-out direction X1, and is the same as the depth direction X. At the attachment position P2, the front panel 1A of the sheet storage portion 1 is flush with a front panel 106A of the housing 106 in the depth direction X (see FIG. 1). It is noted that in FIG. 2, the sheet storage portion 1 drawn out from the attachment position P2 in the draw-out direction X1 is indicated by a two-dot chain line. In addition, the sheet storage portion 1 at the attachment position P2 is indicated by a solid line.

Figure 3A:
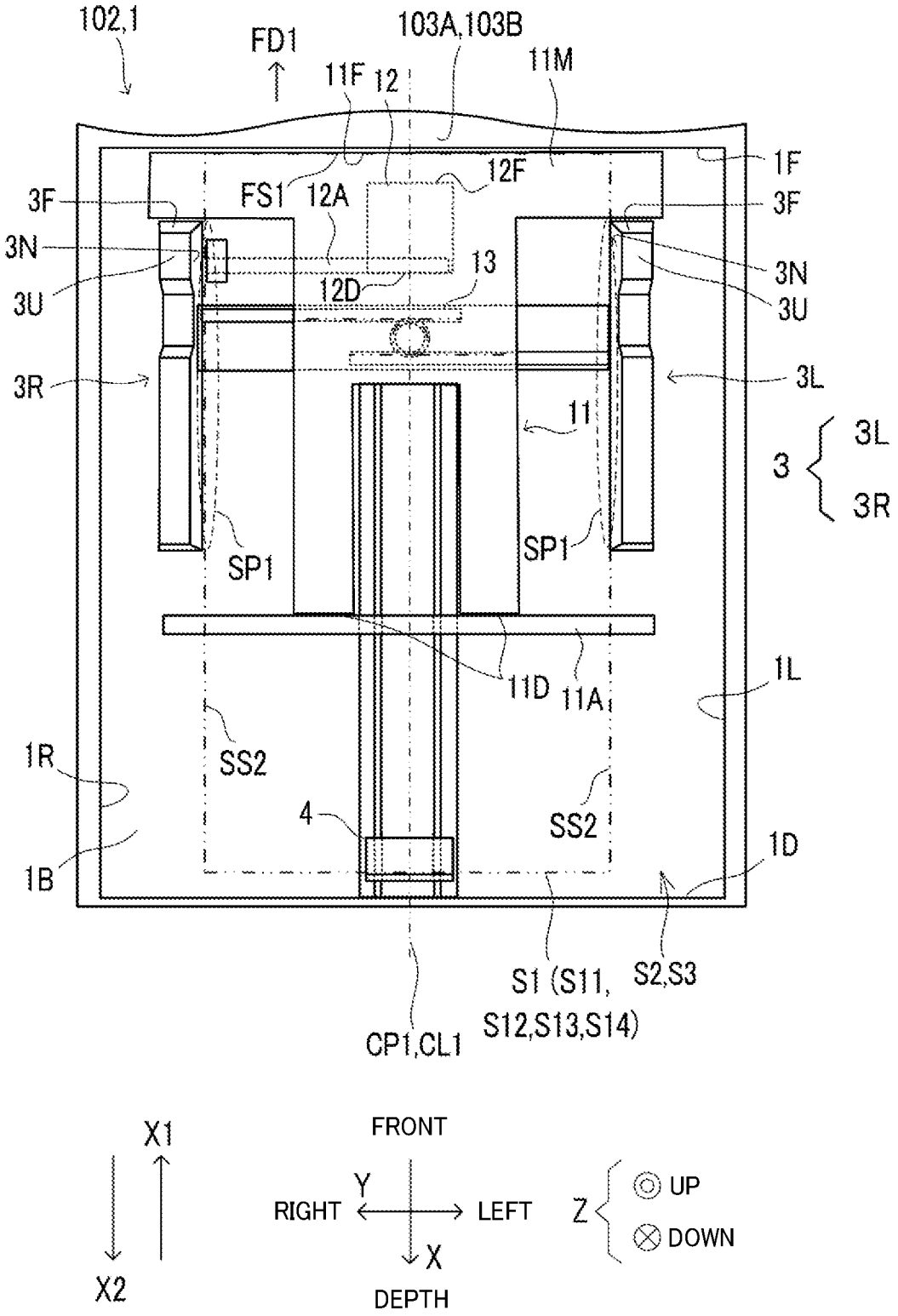
FIG. 3A is a schematic diagram of a sheet storage portion shown in FIG. 2, viewed from above.

The sheet storage portion 1 has a shape of a tray. As shown in FIG. 3A, the sheet storage portion 1 includes the bottom portion 1B. The sheet storage portion 1 further includes four wall surfaces: a front wall surface 1F, a depth wall surface 1D, a left wall surface 1L, and a right wall surface 1R. The bottom portion 1B and the four wall surfaces define a space S2 in which sheets S1 of any of a plurality of types can be stored.

More specifically, the bottom portion 1B has a rectangular shape in a plan view viewed from above. The front wall surface 1F extends in the height direction Z from a front end portion of the bottom portion 1B. The depth wall surface 1D extends in the height direction Z from a rear end portion of the bottom portion 1B. The left wall surface 1L extends in the height direction Z from a left end portion of the bottom portion 1B. The right wall surface 1R extends in the height direction Z from a right end portion of the bottom portion 1B. The right wall surface 1R connects the left end portions of the front wall surface 1F and the depth wall surface 1D with each other. The left wall surface 1L connects the right end portions of the front wall surface 1F and the depth wall surface 1D with each other. An upper end portion of the space S2 is an opening S3 opened upward (see FIG. 2).

Figure 3B:
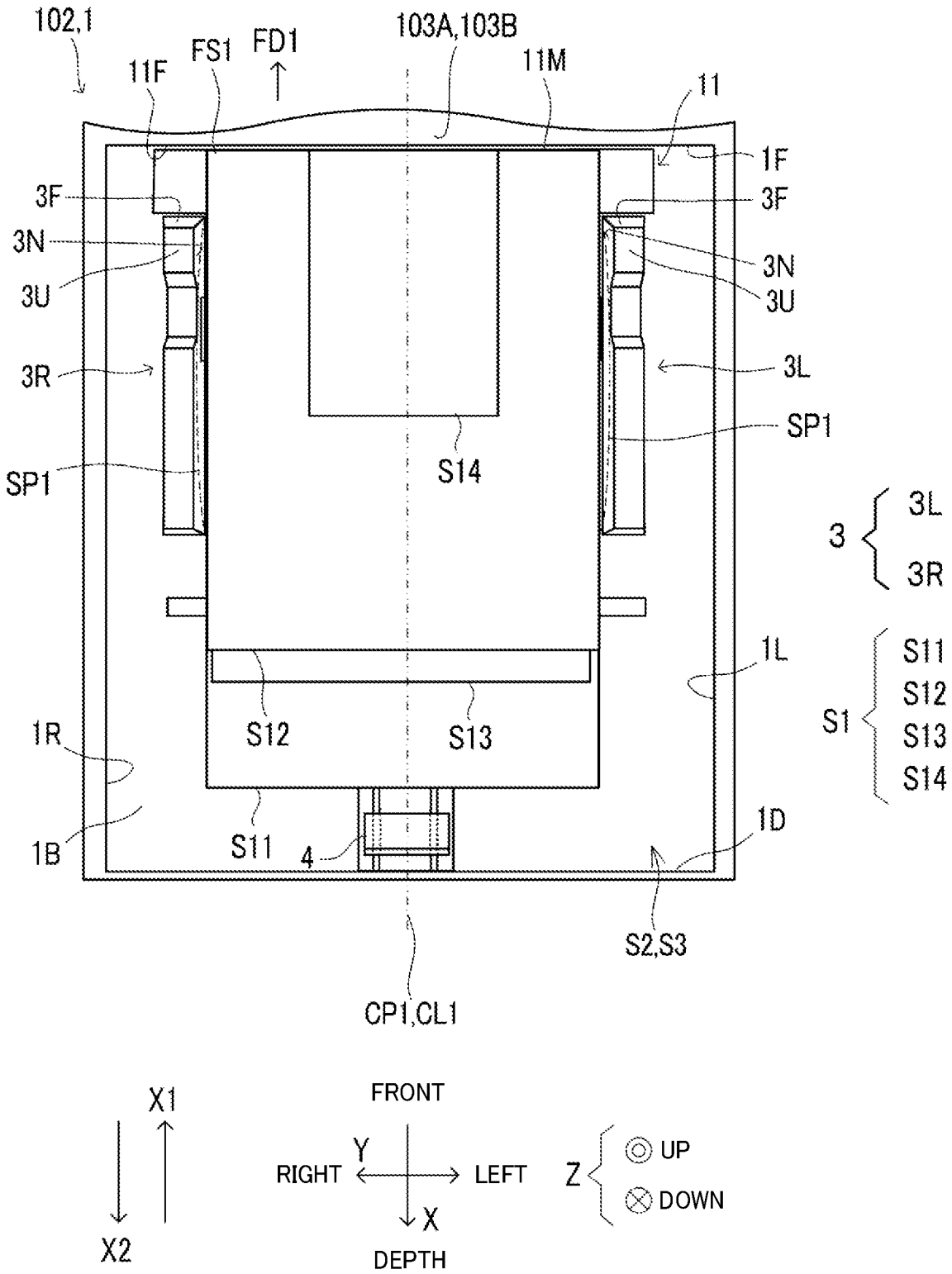
FIG. 3B is a schematic diagram showing sheets that can be stored in the sheet storage portion shown in FIG. 2.

As shown in FIG. 2, a plurality of sheets S1 are stored in the space S2 of the sheet storage portion 1 in a state of being stacked in the height direction Z. Specifically, as shown in FIG. 3B, the sheet storage portion 1 is configured to store the sheets S1 of any of the plurality of types that are different in size of a first side FS1 (first side) that is parallel to the width direction Y. The sheets S1 of the plurality of types include a sheet S11 of the legal size, a sheet S12 of the letter size, a sheet S13 of A4 size, and a sheet S14 of A5 size (see FIG. 3B).

Referring to FIG. 3A, the sheet storage portion 1 includes a sheet placing member 11, a shaft 11A, a lifting member 12, a shaft 12A, the first regulation portion 3, a movement mechanism 13, and the rear end regulation portion 4.

The sheet placing member 11 is made of a metal or the like, and as shown in FIG. 2, has a shape of a thin plate. As shown in FIG. 3A, the sheet placing member 11 is provided on the bottom portion 1B at a position between the regulation plates 3L and 3R and on the front side of the rear end regulation portion 4. The sheet placing member 11 is provided on the bottom portion 1B so as to be symmetrical with respect to the center plane CP1 in the width direction Y. It is noted that in the following description, a symmetrical shape refers to a shape that is symmetrical with respect to the center plane CP1 in the width direction Y. A front end portion 11F of the sheet placing member 11 extends in the width direction Y along the front wall surface 1F. A depth end portion 11D of the sheet placing member 11 extends in the width direction Y at a position close to the depth of the bottom portion 1B (namely, a position close to the depth wall surface 1D). A portion of the sheet placing member 11 close to the front end portion 11F is wider in width than a portion of the sheet placing member 11 close to the depth end portion 11D. As shown in FIG. 2, a type of sheet S1 selected from the plurality of types is placed on a main surface 11M of the sheet placing member 11.

As shown in FIG. 3A, the shaft 11A is provided close to the depth wall surface 1D on the bottom portion 1B so as to extend in the width direction Y. The depth end portion 11D of the sheet placing member 11 is fixed to the shaft 11A. The shaft 11A is supported by the bottom portion 1B so as to be rotatable around a shaft center of the shaft 11A in a rotation direction LD1 (see FIG. 2). It is noted that the front end portion 11F of the sheet placing member 11 is a free end.

The lifting member 12 is made of a metal or the like. As shown in FIG. 3A, the lifting member 12 has a shape of a thin, rectangular plate (see FIG. 2). The lifting member 12 is disposed on the bottom portion 1B at a position close to the front end portion 11F below the sheet placing member 11 to have the symmetrical shape.

The shaft 12A is provided close to the front wall surface 1F on the bottom portion 1B so as to extend in the width direction Y. Specifically, the shaft 12A is fixed along a depth end portion 12D of the lifting member 12. In addition, the shaft 12A is supported by the bottom portion 1B so as to be rotatable around a shaft center of the shaft 12A in a rotation direction LD2 (see FIG. 2). It is noted that a front end portion 12F of the lifting member 12 is a free end.

The shaft 12A is rotated by a power generated by a motor (not shown) provided in the housing 106. This allows the lifting member 12 to rotate in the rotation direction LD2. The front end portion 12F of the lifting member 12 is displaced in the height direction Z while abutting on, from below, a portion of the sheet placing member 11 close to the front end portion 11F. As a result, the sheet placing member 11 rotates around the shaft 11A in the rotation direction LD1, and the front end portion 11F is displaced in the height direction Z. It is noted that the rotation of the shaft 12A is controlled by a control portion (not shown) so that a sheet S1 at the top of a stack of sheets S1 on the sheet placing member 11 abuts on a pickup roller 21.

As shown in FIG. 3A, the first regulation portion 3 stands on a bottom surface of the bottom portion 1B of the sheet storage portion 1, and extends upward from the bottom portion 1B. The first regulation portion 3 includes a pair of regulation plates 3L and 3R. The regulation plates 3L and 3R extend upward from the bottom portion 1B of the sheet storage portion 1. The first regulation portion 3 regulates the position of the sheets S1 on the sheet placing member 11 in the width direction Y. It is noted that the width direction Y is perpendicular to a feed direction FD1 that is described below.

The regulation plates 3L and 3R conform to what is called a center registration method. The regulation plates 3L and 3R are configured to move in the space S2 in the width direction Y along the bottom portion 1B. The regulation plate 3L has an inner surface 3N that abuts on, from left, a specific portion SP1 of a left second side SS2 (second side) of the sheets S1 on the sheet placing member 11. The regulation plate 3R has an inner surface 3N that abuts on, from right, a specific portion SP1 of a right second side SS2 of the sheets S1 on the sheet placing member 11. The second sides SS2 are perpendicular to the first side FS1. The inner surfaces 3N are parallel to the ZX plane. The regulation plates 3L and 3R regulate the position of the sheets S1 on the sheet placing member 11 in the width direction Y by abutting on the second sides SS2 of the sheets S1 from the opposite sides in the width direction Y (namely from both of the left direction and the right direction). A center line CL1 of the sheets S1 passing through a center thereof in the width direction Y is included in the center plane CP1.

As shown in FIG. 3A, the regulation plate 3L is provided on a left portion of the bottom portion 1B with respect to the center plane CP1. In addition, the regulation plate 3L is provided on the draw-out direction X1 side on the bottom portion 1B.

The regulation plate 3L has a predetermined width in the width direction Y (see FIG. 3A), and has predetermined depth and height. Specifically, the regulation plate 3L includes a front end portion 3F and an upper end portion 3U. The front end portion 3F is an end portion located on the draw-out direction X1 side. As shown in FIG. 3A, a portion of the sheet placing member 11 close to the front end portion 11F is wider in width than a portion of the sheet placing member 11 close to the depth end portion 11D. The front end portion 3F of the regulation plate 3L is located on the depth side of the front end portion 11F of the sheet placing member 11, and separated from the front wall surface 1F in the insertion direction X2. As shown in FIG. 2, the upper end portion 3U is provided at a position H1 that is higher than a specific portion SP1 of a top sheet S1. The top sheet S1 is a sheet S1 at the top of the plurality of sheets S1 stacked on the sheet placing member 11.

Figure 4:
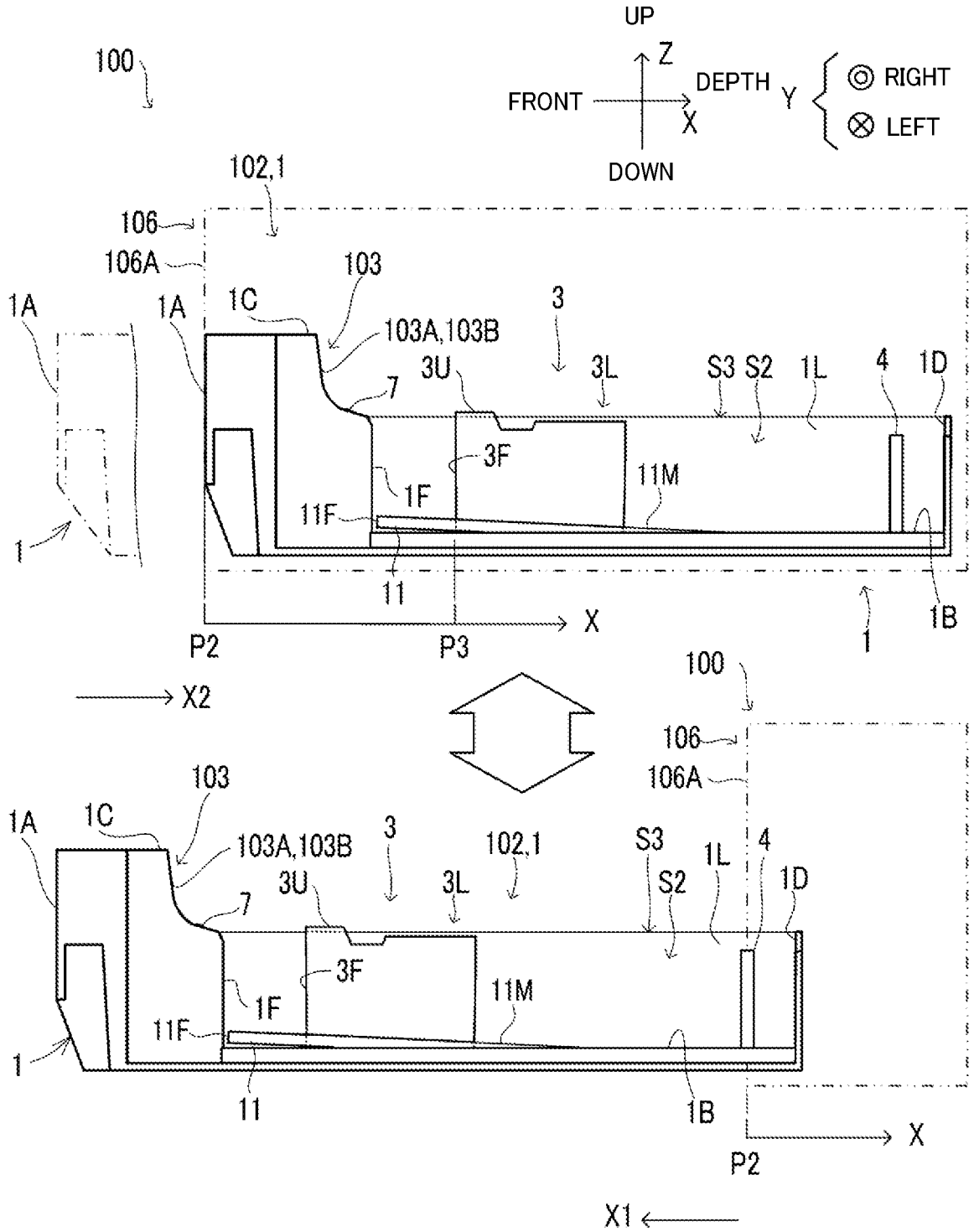
FIG. 4 is a schematic diagram showing an attachment position of the sheet storage portion shown in FIG. 3A, and a specific position of a first regulation portion.

As shown in FIG. 4, when the sheet storage portion 1 is pushed in, the regulation plate 3L moves together with the sheet storage portion 1 in the insertion direction X2 toward a specific position P3. In addition, when the sheet storage portion 1 is drawn out, the regulation plate 3L moves together with the sheet storage portion 1 in the draw-out direction X1 from the specific position P3. The specific position P3 is a position of the front end portion 3F corresponding to the attachment position P2. When the sheet storage portion 1 and the regulation plate 3L are respectively positioned at the attachment position P2 and the specific position P3, it is possible for the feed portion 2 (see FIG. 2) to feed the sheets S1 on the sheet placing member 11 in the feed direction FD1.

It is noted that the regulation plate 3R is provided on the bottom portion 1B so that the regulation plate 3R and the regulation plate 3L form the symmetrical shape. As a result, description of a specific configuration of the regulation plate 3R is omitted.

Referring to FIG. 3A, the movement mechanism 13 is, for example, a rack and pinion mechanism. The rack and pinion mechanism includes a pinion gear and two rack gears. The pinion gear is provided on the bottom portion 1B so as to be rotatable around a rotation axis that is parallel to the height direction Z. The two rack gears respectively extend from the regulation plates 3L and 3R toward the pinion gear, and mesh with the pinion gear. The user moves one of the regulation plates 3L and 3R toward one side of the width direction Y (namely, leftward or rightward). In response to the movement, the movement mechanism 13 causes the other of the regulation plates 3L and 3R to move by the same movement amount as that of the one of the regulation plates 3L and 3R. With this configuration, the regulation plates 3L and 3R hold the sheets S1 on the sheet placing member 11 from the opposite sides of the width direction Y (namely, from left and right). This allows the first regulation portion 3 to match the center line CL1 of the sheets S1 to the center plane CP1, and regulate the position of the sheets S1 in the width direction Y.

Figure 6:
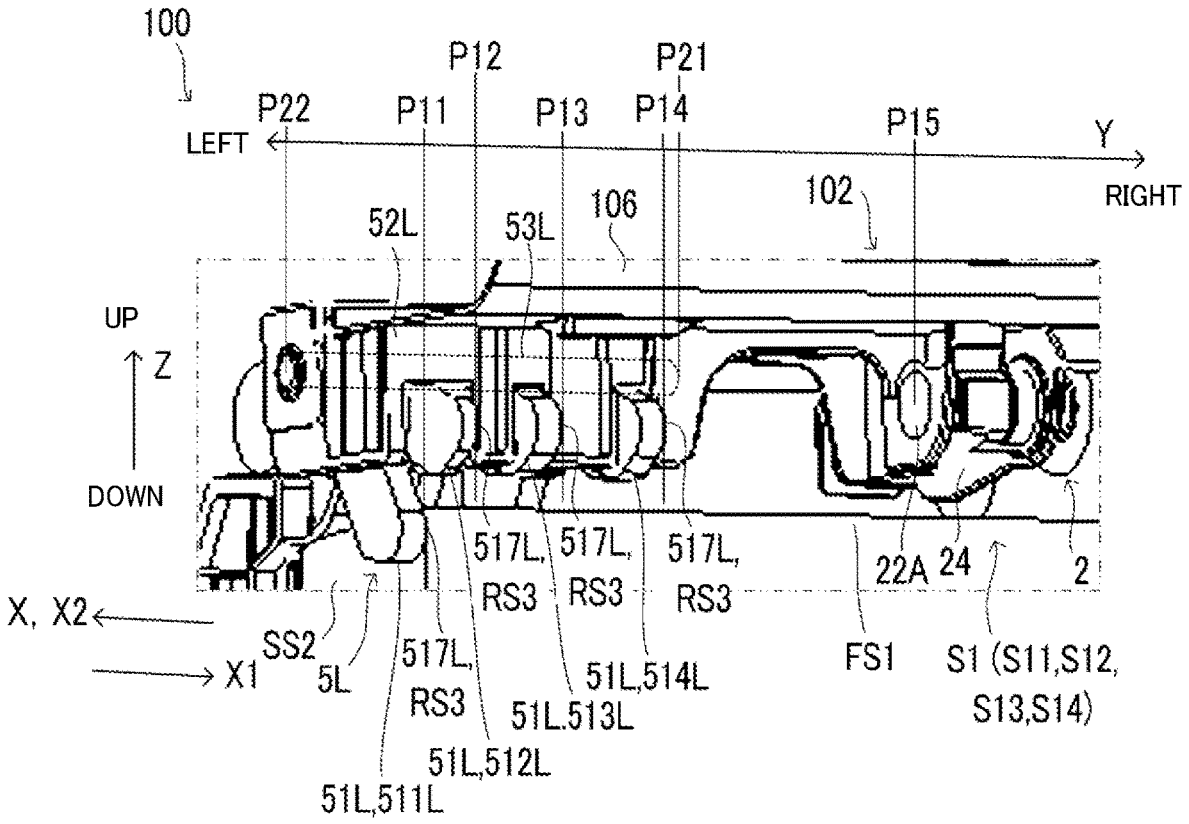
FIG. 6 is a diagram showing positions P11 to P14 at which four regulation levers shown in FIG. 5 are disposed.

Each of the regulation plates 3L and 3R is moved in the width direction Y by the movement mechanism 13 so as to be positioned at any one of a plurality of predetermined positions P11 to P14 (see FIG. 6). This makes it possible to regulate the position of the sheets S11 to S14 of the plurality of types (see FIG. 3B) in the width direction Y.

As shown in FIG. 2, the rear end regulation portion 4 extends upward from a position on the bottom portion 1B close to the depth wall surface 1D. The rear end regulation portion 4 can be moved in both the draw-out direction X1 and the insertion direction X2 by a user operation. As shown in FIG. 3A, the rear end regulation portion 4 operated by the user abuts on the sheets S1 on the sheet placing member 11 from the depth side, and causes the first side FS1 of the sheets S1 to be along the front wall surface 1F. This allows the rear end regulation portion 4 to regulate the position of the sheets S1 in the depth direction X. Upon being positioned in the depth direction X, the first side FS1 of the sheets S1 is along the front wall surface 1F.

Referring to FIG. 2, the conveyance path 103 is a path along which a sheet S1 fed from the sheet storage portion 1 is conveyed, and the conveyance path 103 is represented by a dotted line. The shape of the conveyance path 103 resembles a horizontally flipped letter "S" in a plan view viewed from right. The transfer region R1 and the fixing portion 104 are provided in the middle of the conveyance path 103. The conveyance path 103 reaches the discharge portion 105.

Referring to FIG. 2, the conveyance path 103 includes a guide portion 103A. The guide portion 103A is provided on the draw-out direction X1 side from the space S2 in the sheet storage portion 1. The guide portion 103A includes a curved guide surface 103B whose width is the same as the longest side length. The guide surface 103B is parallel to the width direction Y. The guide portion 103A guides a sheet S1 fed by the feed portion 2 from the space S2 of the sheet storage portion 1, toward the downstream in the feed direction FD1 (namely the conveyance path 103) along the guide surface 103B.

Referring to FIG. 2, the feed portion 2 is provided in the housing 106 of the image forming apparatus 100. The feed portion 2 picks up the sheets S1 stacked on the sheet placing member 11 one by one, and feeds it in the feed direction FD1 (see FIG. 2). The feed direction FD1 is perpendicular to the width direction Y. Specifically, the feed direction FD1 extends along the main surface 11M of the sheet placing member 11, and is directed diagonally up frontward.

The feed portion 2 includes a pickup roller 21, a conveyance roller 22, and a retard roller 23. The pickup roller 21 and the conveyance roller 22 are disposed close to the center plane CP1 in the width direction Y (see FIG. 5).

The pickup roller 21 feeds, in the feed direction FD1, a sheet S1 at the top of the sheets S1 stored in the sheet storage portion 1 by rotating while abutting on the sheet S1.

Specifically, when the sheet storage portion 1 is located at the attachment position P2, the pickup roller 21 is positioned between the front wall surface 1F and the front end portion 3F of the first regulation portion 3 in the depth direction X. The pickup roller 21 is disposed so as to abut on the top sheet S1 at a position lower than the upper end portion 3U of the first regulation portion 3. The pickup roller 21 is supported by the housing 106 so as to be rotatable around the rotation shaft 21A that extends in the width direction Y. The pickup roller 21 is rotated by a power transmitted from a motor (not shown) that is provided in the housing 106. The rotated pickup roller 21 feeds the top sheet S1 in the feed direction FD1 so as to supply it onto the guide portion 103A.

The conveyance roller 22 is disposed diagonally upward from the guide portion 103A on the draw-out direction X1 side of the pickup roller 21 and the front wall surface 1F. The conveyance roller 22 is supported by the housing 106 so as to be rotatable around a shaft 22A that extends in the width direction Y. The conveyance roller 22 is rotated by a power transmitted from the motor (not shown), and feeds a sheet S1 supplied to the guide portion 103A toward the downstream in the feed direction FD1.

Figure 8:
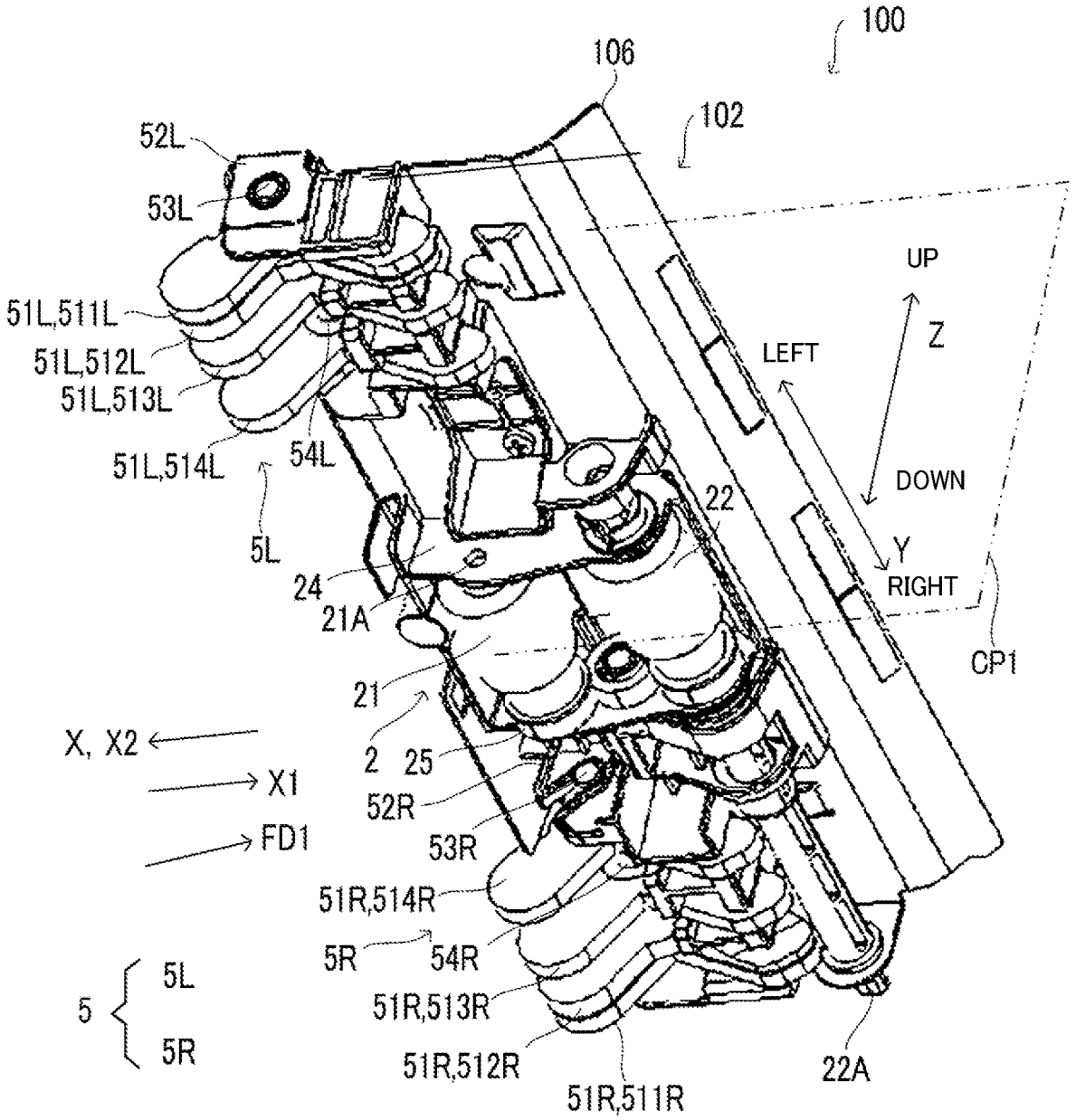
FIG. 8 is a schematic diagram showing a detailed configuration of a right second regulation portion shown in FIG. 6.

More specifically, the pickup roller 21 and the conveyance roller 22 are provided in a holder 24 (see FIG. 8). The pickup roller 21 is rotated in synchronism with the conveyance roller 22 by a power transmitted from the shaft 22A via a power transmitting portion 25 (see FIG. 8).

The retard roller 23 is provided in the sheet storage portion 1. The retard roller 23 extends in the width direction Y at a position close to the front wall surface 1F in the guide portion 103A. An upper end portion of the retard roller 23 projects with respect to the guide portion 103A. The retard roller 23 is supported by the sheet storage portion 1 so as to be rotatable around a shaft center 23A that extends in the width direction Y. When the sheet storage portion 1 is located at the attachment position P2, the retard roller 23 abuts on the conveyance roller 22 from below to form a nip N1. The retard roller 23 is driven and rotated by the rotation of the conveyance roller 22. In addition, when a plurality of sheets S1 are fed at once from the pickup roller 21, the retard roller 23 is neither driven nor rotated, due to the action of the torque limiter. With this configuration, the conveyance roller 22 conveys only the top sheet S1 among the plurality of sheets S1 toward the downstream in the feed direction FD1.

A front end portion of the sheet S1 in the feed direction FD1 is supplied to the guide portion 103A, and then inserted in the nip N1. The sheet S1 is further conveyed toward the downstream side of the conveyance path 103 by the rotation of the conveyance roller 22, and sent to the transfer region R1. It is noted that when the front end portion of the sheet S1 abuts on the retard roller 23 first before abutting on the conveyance roller 22, the sheet S1 may be damaged or clog the guide portion 103A, with a relatively large collision sound. For this reason, a guide member such as a film is preferably provided on a portion of the conveyance path 103 that is on the front wall surface 1F side of the retard roller 23 so that the front end portion of the sheet S1 abuts on the conveyance roller 22 first. It is noted that the portion of the guide portion 103A may have a shape which allow the front end portion of the sheet S1 to abut on the conveyance roller 22 first.

Referring to FIG. 2, the image forming portion 101 forms an image on a sheet S1 fed by the sheet feed device 102. Specifically, the transfer portion 205 transfers an image conveyed to the transfer region R1 by the image carrier 201, onto a sheet S1 that is fed to the transfer region R1. The sheet S1 with the image transferred thereon is conveyed to the fixing portion 104. In the fixing portion 104, the image is fixed to the sheet S1. Thereafter, the sheet S1 with the image fixed thereto is discharged onto the discharge portion 105 as a print.

Meanwhile, according to the above-mentioned conventional image forming apparatus, the sheet stops at the stoppers until a skew is corrected by the stoppers. It is desired, however, that a skew is restricted from being generated in a sheet without stopping the sheet once the sheet is fed in the feed direction. On the other hand, the image forming apparatus 100 according to the present embodiment is configured to restrict a skew from being generated without stopping the sheet S1.

Figure 5:
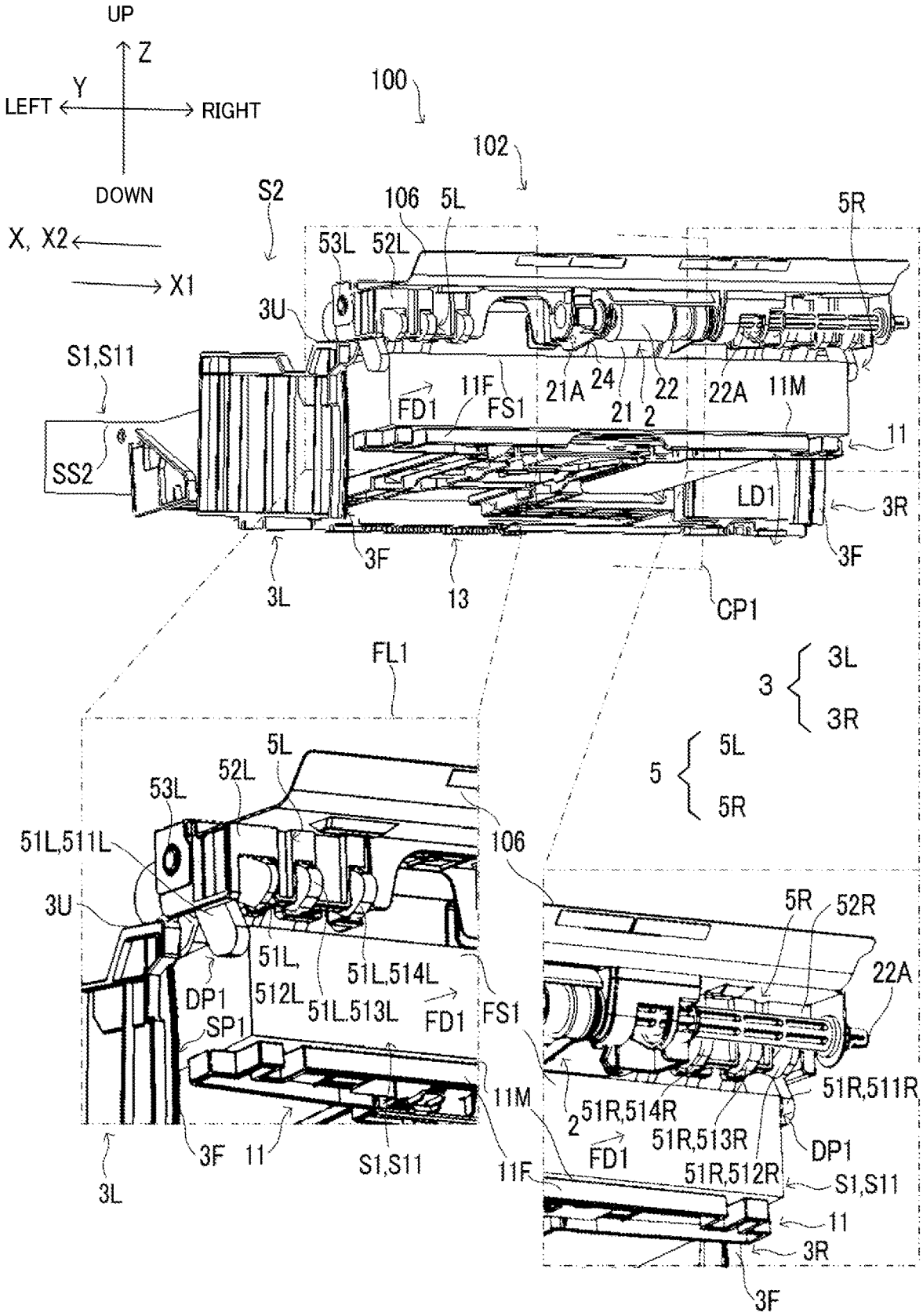
FIG. 5 is a diagram showing a detailed configuration of a pickup roller and a conveyance roller shown in FIG. 3A, and showing a sheet feed device according to the embodiment.

Referring to FIG. 5, the second regulation portion 5 is provided in the housing 106 of the image forming apparatus 100. The second regulation portion 5 abuts on the second side(s) SS2 of the sheets S1 stacked on the sheet placing member 11, at the downstream of the first regulation portion 3 in the feed direction FD1, from at least one side of the width direction Y. This allows the second regulation portion 5 to regulate the position of the sheet S1 fed by the feed portion 2, in the width direction Y.

Specifically, the second regulation portion 5 includes a left second regulation portion 5L and a right second regulation portion 5R, as a pair. The left second regulation portion 5L includes four regulation levers 51L, a support portion 52L, a shaft 53L, and four biasing members 54L (see FIG. 7A and FIG. 7B).

The support portion 52L is provided in the housing 106. Specifically, the support portion 52L is attached to the housing 106 at a position on the left side of the pickup roller 21 and the conveyance roller 22 in the width direction Y. In addition, the support portion 52L is attached to the housing 106 at a position close to the front end portion 11F of the sheet placing member 11 in the feed direction FD1. In addition, the support portion 52L is attached to the housing 106 at a position higher than the lower end of the pickup roller 21 in the height direction Z.

As shown in FIG. 6, the shaft 53L is provided in the support portion 52L so as to extend in the width direction Y. Here, FIG. 6 shows the positions P11 to P14 in the width direction Y. P11 represents a position in the width direction Y of the left second side SS2 of the sheets S11 stacked on the sheet placing member 11. Similarly, P12, P13, and P14 respectively represent positions of the left second sides SS2 of the sheets S12, S13, and S14 stacked on the sheet placing member 11. The shaft 53L extends in the width direction Y between positions P21 and P22. The position P21 is located between the position P14 and a position P15, wherein the position P15 is a position of the left end portion of the shaft 22A of the feed portion 2. The position P22 is separated leftward from the position P11.

The four regulation levers 51L are provided in correspondence with the sheets S11 to S14 (see FIG. 3B). Each of the four regulation levers 51L is disposed to face the first regulation portion 3 (more specifically, the regulation plate 3L) disposed at one of the positions P11 to P14. Each of the four regulation levers 51L, when it faces the regulation plate 3L, abuts on the second side SS2 of one of the sheets S11 to S14 that is regulated by the regulation plate 3L, from one side of the width direction Y (specifically, from left).

Among the four regulation levers 51L, a regulation lever 51L corresponding to the sheet S11 is called a first regulation lever 511L. In addition, a regulation lever 51L corresponding to the sheet S12 is called a second regulation lever 512L; a regulation lever 51L corresponding to the sheet S13 is called a third regulation lever 513L; and a regulation lever 51L corresponding to the sheet S14 is called a fourth regulation lever 514L. It is noted that the number of the regulation levers 51L of the left second regulation portion 5L may be other than 4 (four).

Figure 7A:
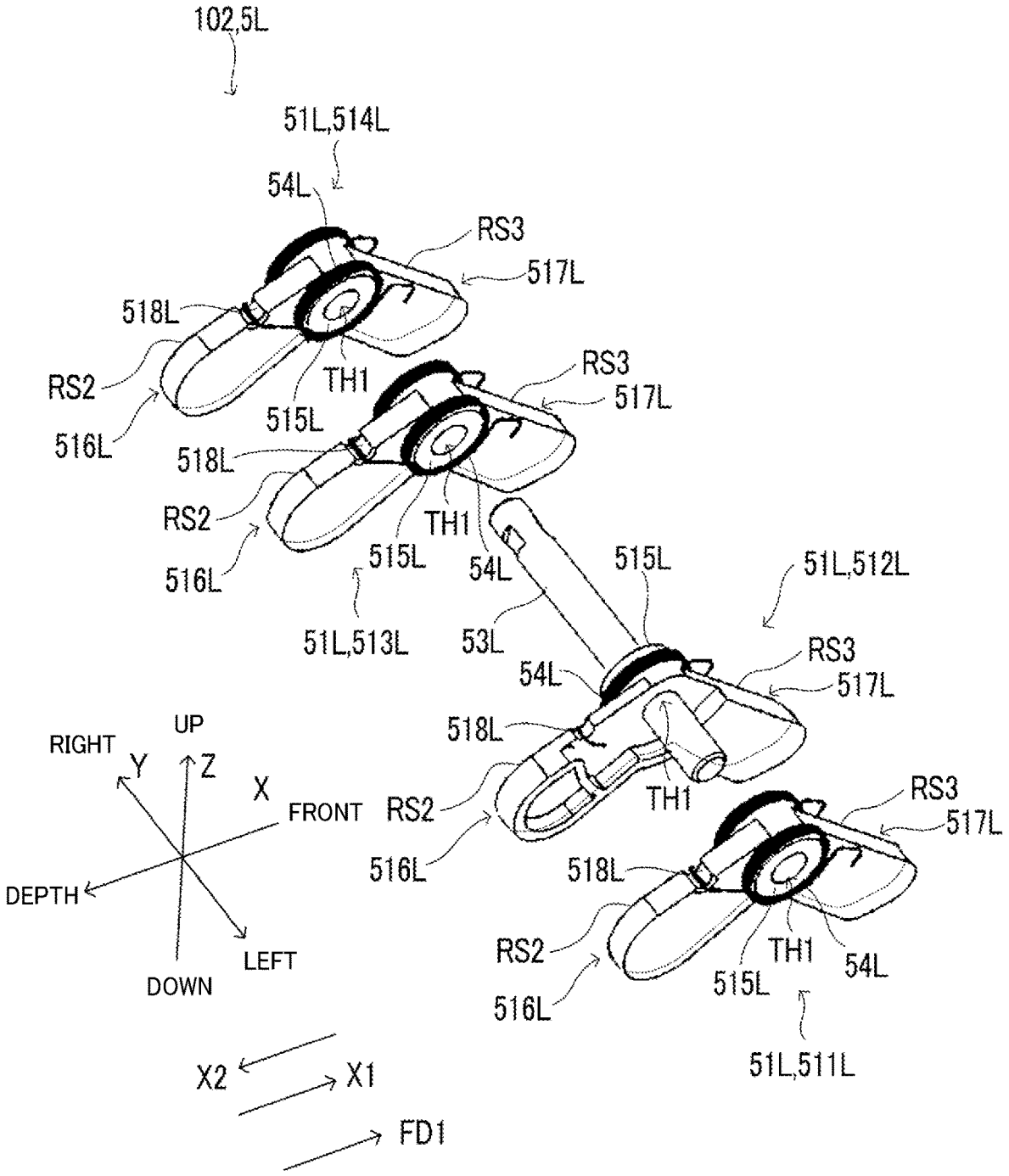
FIG. 7A is a perspective diagram showing a left second regulation portion 5L shown in FIG. 5 in an exploded state.

As shown in FIG. 7A, each of the four regulation levers 51L includes a base portion 515L, a first arm portion 516L, and a second arm portion 517L.

Each base portion 515L is supported by the shaft 53L in such a way as to pivot around the shaft 53L. Specifically, each base portion 515L has a disk shape and has a through hole TH1. The shaft 53L is inserted in the through holes TH1 such that the base portions 515L can pivot around the shaft 53L in the ZX plane.

The first arm portion 516L, the second arm portion 517L, and the base portion 515L are integrally provided with each other in each regulation lever 51L. The first arm portion 516L and the second arm portion 517L each have a predetermined thickness in the width direction Y.

Each first arm portion 516L extends from a corresponding base portion 515L toward the upstream in the feed direction FD1. A right side surface RS2 of each first arm portion 516L is parallel to the ZX plane. The right side surfaces RS2 have the same outer appearance. In each right side surface RS2, a portion on the upstream side in the feed direction FD1 is curved in an arc shape.

Each second arm portion 517L extends from a corresponding base portion 515L toward the downstream in the feed direction FD1. A right side surface RS3 of each second arm portion 517L is parallel to the ZX plane. The right side surfaces RS3 have the same outer appearance. In each regulation lever 51L, the right side surface RS3 is provided at the same position in the width direction Y as the right side surface RS2. In each right side surface RS3, a portion on the downstream side in the feed direction FD1 is curved in an arc shape.

Each of the four biasing members 54L is a torsion spring or the like. The four biasing members 54L are respectively provided in correspondence with the four regulation levers 51L. Each biasing member 54L is wound around a corresponding base portion 515L. One end of each biasing member 54L extends toward the upstream in the feed direction FD1, and is engaged with an engaging portion 518L formed in a corresponding first arm portion 516L.

Figure 7B:
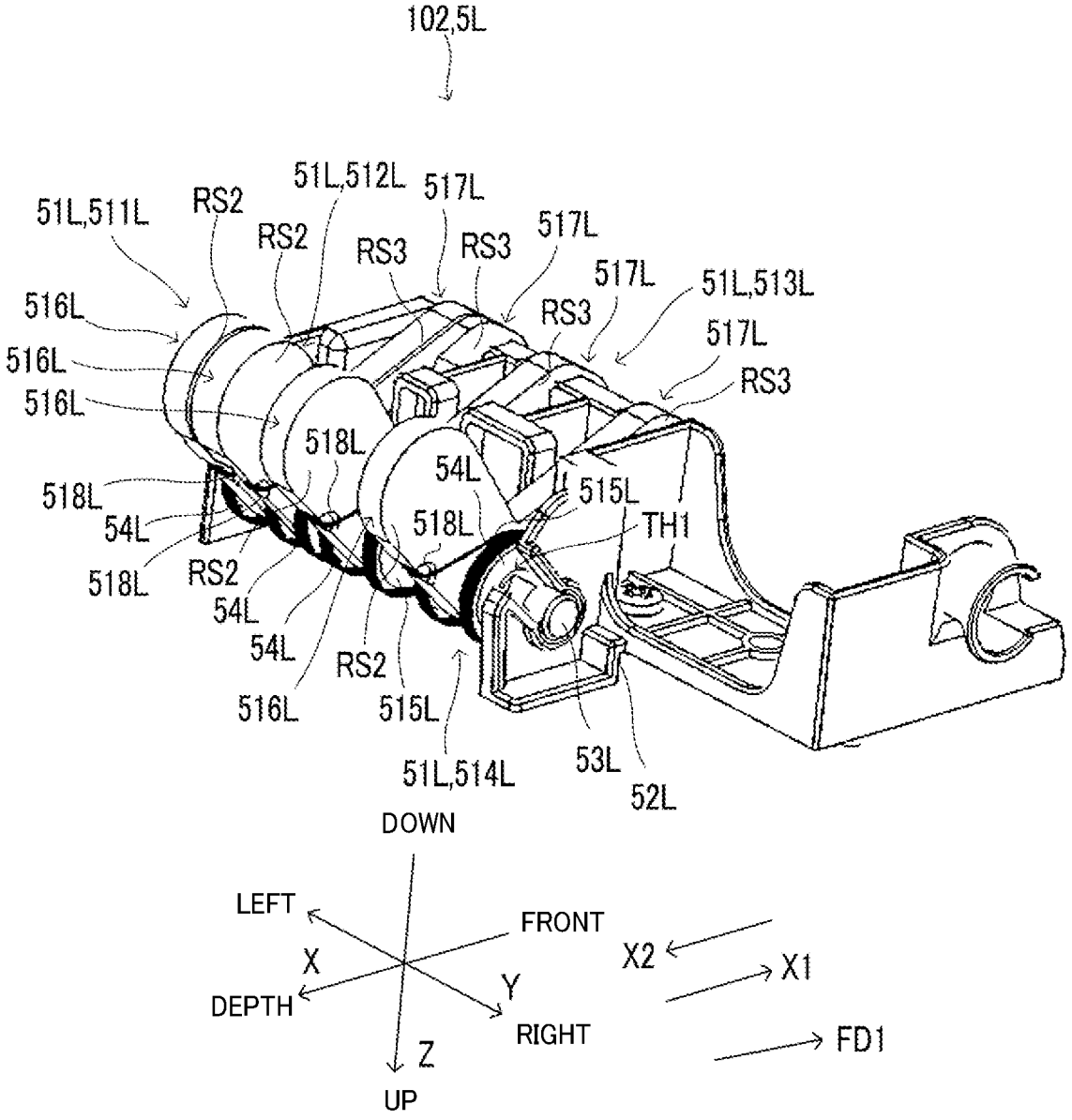
FIG. 7B is a perspective diagram showing the left second regulation portion 5L shown in FIG. 5 in an assembled state.

As shown in FIG. 7B, the shaft 53L is inserted in the through holes TH1 of the regulation levers 51L. This allows the base portions 515L to be supported by the shaft 53L in such a way as to pivot around the shaft center of the shaft 53L that extends in the width direction Y. Opposite ends of the shaft 53L are attached to the support portion 52L. In addition, the other end of each biasing member 54L extends toward the downstream in the feed direction FD1, and is engaged with the support portion 52L. With this configuration, the first arm portion 516L and the second arm portion 517L sway around the shaft 53L in conjunction with pivoting of the base portion 515L.

As shown in FIG. 6, the first regulation lever 511L is disposed such that the right side surface RS3 of the first regulation lever 511L is parallel to the ZX plane at the position P11 when the support portion 52L is attached to the housing 106. Similarly, the second regulation lever 512L is disposed such that the right side surface RS3 of the second regulation lever 512L is parallel to the ZX plane at the position P12. The third regulation lever 513L is disposed such that the right side surface RS3 of the third regulation lever 513L is parallel to the ZX plane at the position P13. The fourth regulation lever 514L is disposed such that the right side surface RS3 of the fourth regulation lever 514L is parallel to the ZX plane at the position P14.

Referring to FIG. 8, the right second regulation portion 5R includes four regulation levers 51R, a support portion 52R, a shaft 53R, and four biasing members 54R. Among the four regulation levers 51R, a regulation lever 51R corresponding to the sheet S11 is called a first regulation lever 511R. In addition, a regulation lever 51R corresponding to the sheet S12 is called a second regulation lever 512R; a regulation lever 51R corresponding to the sheet S13 is called a third regulation lever 513R; and a regulation lever 51R corresponding to the sheet S14 is called a fourth regulation lever 514R. It is noted that FIG. 8 shows only one biasing member 54R and only one biasing member 54L.

The support portion 52R is provided in the housing 106 so that the support portion 52R and the support portion 52L form the symmetrical shape. The shaft 53R is provided in the support portion 52R so that the shaft 53R and the shaft 53L form the symmetrical shape. The first regulation lever 511R is provided in the support portion 52R so that the first regulation lever 511R and the first regulation lever 511L form the symmetrical shape. The second regulation lever 512R is provided in the support portion 52R so that the second regulation lever 512R and the second regulation lever 512L form the symmetrical shape. The third regulation lever 513R is provided in the support portion 52R so that the third regulation lever 513R and the third regulation lever 513L form the symmetrical shape. The fourth regulation lever 514R is provided in the support portion 52R so that the fourth regulation lever 514R and the fourth regulation lever 514L form the symmetrical shape. Each biasing member 54R is provided in the support portion 52R so that the biasing members 54R and a corresponding biasing member 54L form the symmetrical shape. As a result, detailed description of the right second regulation portion 5R is omitted.

Figure 9A:
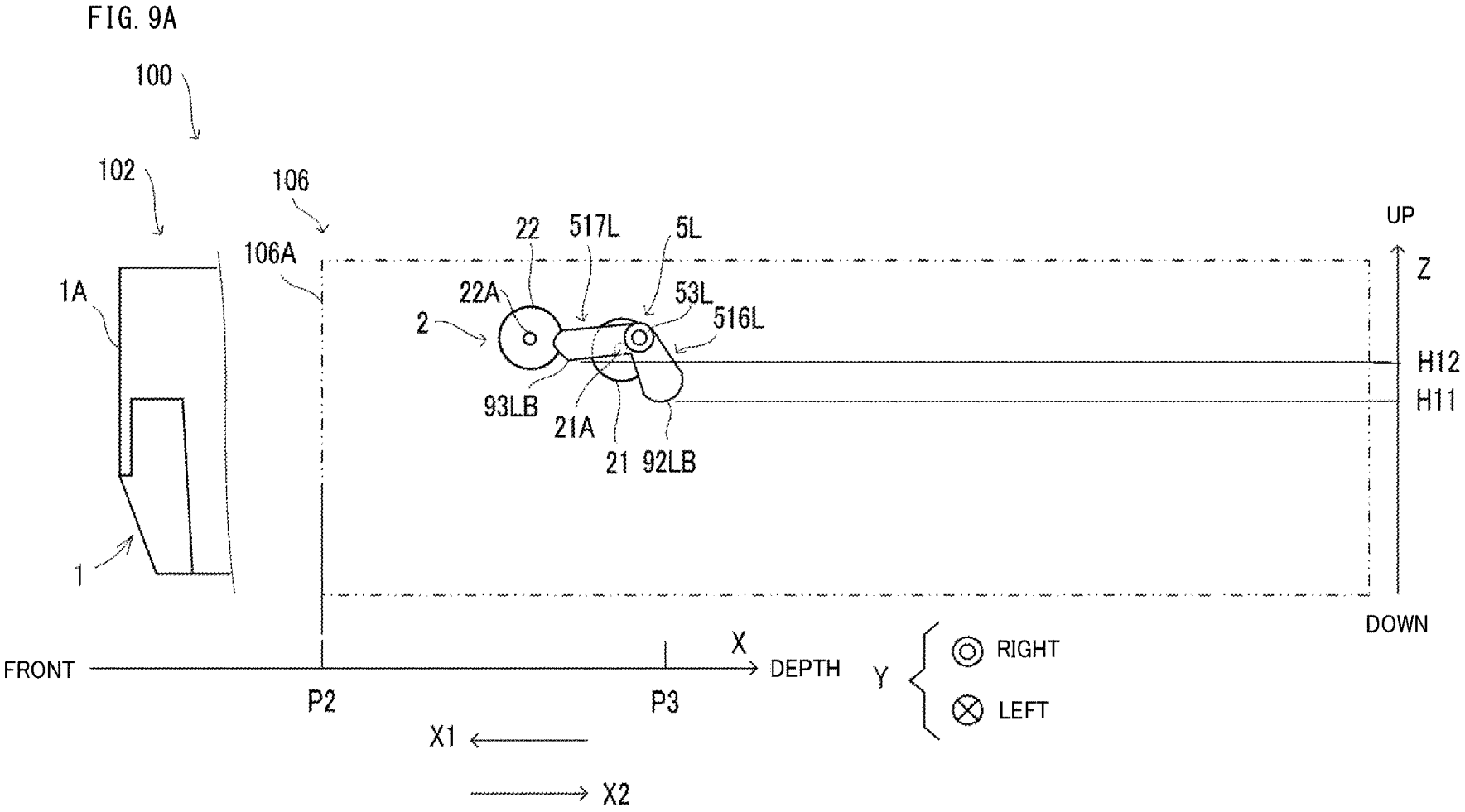
FIG. 9A is a schematic diagram showing a first lower position H11 of a first arm portion shown in FIG. 7A and FIG. 7B and showing a second upper position H12 of a second arm portion.

Each biasing member 54L (see FIG. 7A and FIG. 7B) biases a corresponding first arm portion 516L downward. Specifically, the specification of each biasing member 54L is appropriately determined such that as shown in FIG. 9A, when the sheet storage portion 1 has been drawn out from the attachment position P2 in the draw-out direction X1, a lower end portion 92LB of each first arm portion 516L is located at a first lower position H11. The first lower position H11 is lower than the upper end portion 3U (see FIG. 4) of the regulation plate 3L, and when the lower end portion 92LB is located at the first lower position H11, the first arm portion 516L faces the regulation plate 3L at the upstream side in the feed direction FD1. In addition, a lower end portion 93LB of each second arm portion 517L is disposed on the draw-out direction X1 side of a corresponding first arm portion 516L, and as shown in FIG. 9A, when the sheet storage portion 1 has been drawn out from the attachment position P2 in the draw-out direction X1, the lower end portion 93LB is located at a second upper position H12. The second upper position H12 is positioned higher than the upper end portion 3U (see FIG. 9B).

As shown in FIG. 3B, the regulation plates 3L and 3R regulate the position of the sheets S1 stacked on the sheet placing member 11 that are one of the sheets S11 to S14. For example, when the regulation plates 3L and 3R regulate the position of the sheets S11, the first regulation lever 511L operates as a regulation lever of the present disclosure. In this case, during the process where the regulation plate 3L moves to the specific position P3 (see FIG. 9B), the upper end portion 3U of the regulation plate 3L first passes below the lower end portion 93LB that is included in the second arm portion 517L of the first regulation lever 511L and is located at the second upper position H12.

Figure 9B:
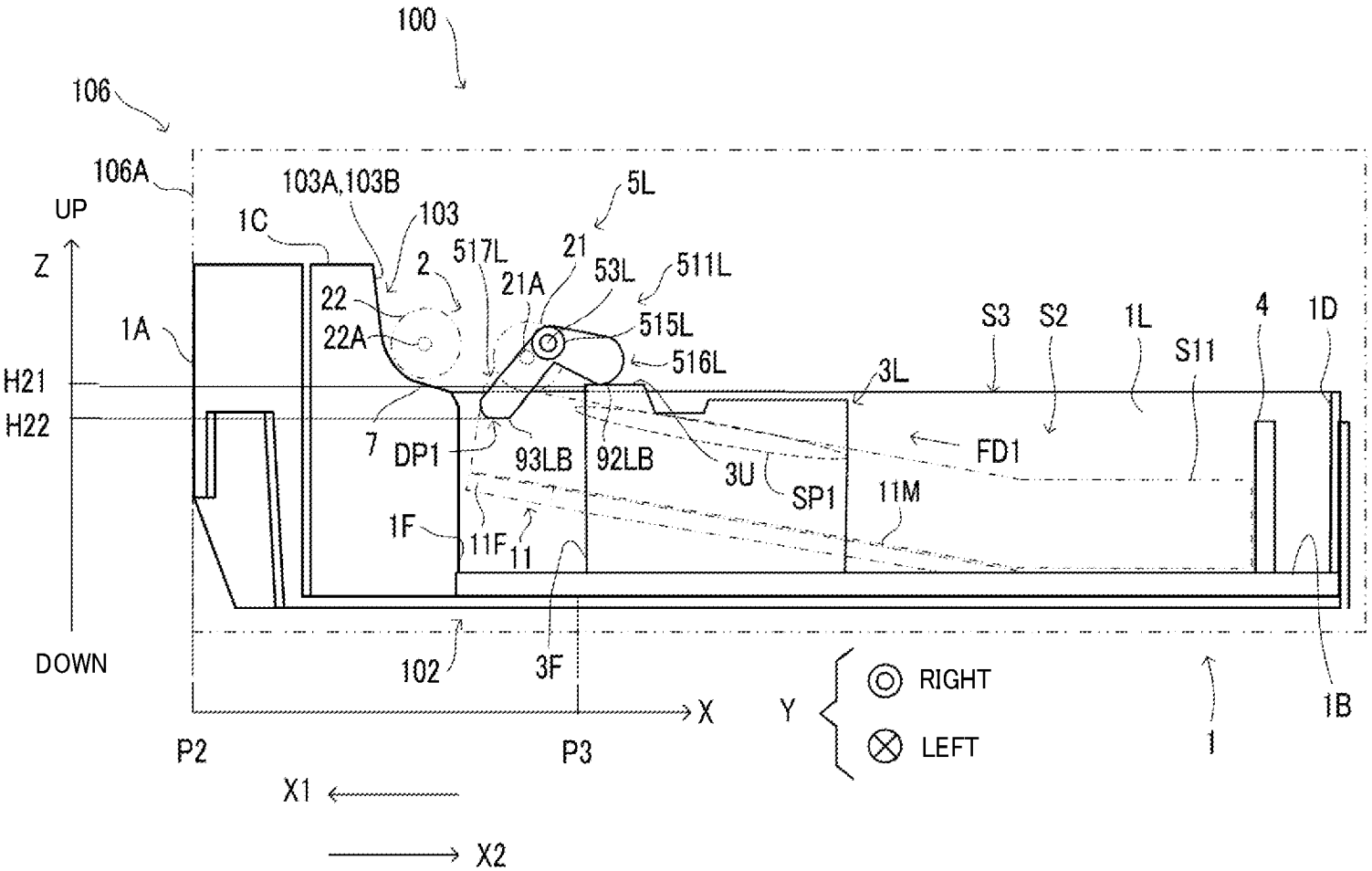
FIG. 9B is a schematic diagram showing a first upper position H21 of the first arm portion shown in FIG. 7A and FIG. 7B and a second lower position H22 of the second arm portion.

As shown in FIG. 9B, the upper end portion 3U of the regulation plate 3L abuts on the lower end portion 93LB of the first regulation lever 511L. Upon receiving a force from the upper end portion 3U, the first arm portion 516L of the first regulation lever 511L causes a corresponding base portion 515L to pivot around the shaft 53L. When the base portion 515L pivots, the lower end portion 92LB of the first arm portion 516L is displaced from the first lower position H11 to a first upper position H21 where it abuts on the upper end portion 3U of the regulation plate 3L.

With the rotation of the base portion 515L, the lower end portion 93LB of the second arm portion 517L of the first regulation lever 511L is displaced from the second upper position H12 (see FIG. 9A) to a second lower position H22. The second lower position H22 is an example of a lower position of the present disclosure. The second lower position H22 is lower than the upper end portion 3U, and when the lower end portion 93LB is located at the second lower position H22, the second arm portion 517L faces the front end portion 3F of the regulation plate 3L at the downstream of the specific portion SP1 of the sheets S11 in the feed direction FD1. In addition, as shown in FIG. 6, the right side surface RS3 of the second arm portion 517L is disposed at the position P11 in the width direction Y. As a result, as shown in FIG. 9B, the second arm portion 517L abuts on, from left, a first portion DP1 of the sheets S11 that is on the downstream side of the specific portion SP1 of the left second side SS2 (see FIG. 3B) of the sheets S11 in the feed direction FD1. Accordingly, the second lower position H22 is also a position where the first portion DP1 is abutted.

It is noted that the first regulation lever 511R and the first regulation lever 511L form the symmetrical shape. As a result, the second arm portion 517R of the first regulation lever 511R abuts on, from right, the first portion DP1 of the sheets S11 located on the downstream side of the specific portion SP1 of the right second side SS2 of the sheets S11 in the feed direction FD1. That is, when the regulation plates 3L and 3R regulate the position of the sheets S11 that are sheets S1 having a first size in the width direction Y, the first regulation levers 511L and 511R abut on, from opposite sides in the width direction Y, the first portion DP1 of the sheets S11 that is on the downstream side of the specific portion SP1 of the sheets S11 in the feed direction FD1. It is noted that the first regulation levers 511L and 511R are an example of a pair of regulation levers of the present disclosure.

In a case where the first regulation portion 3 regulates the position of the sheets S11 (see FIG. 4), the feed portion 2 (see FIG. 9B) feeds the sheets S11 one by one from the sheet storage portion 1 to the conveyance path 103 in the feed direction FD1. During this process, the first regulation lever 511L guides the sheet S11 so that the sheet S11 is conveyed to the downstream side in the feed direction FD1 without being deviated to the left, between the front end portion 3F of the regulation plate 3L and the front wall surface 1F of the sheet storage portion 1. Similarly, the first regulation lever 511R guides the sheet S11 so that the sheet S11 is conveyed to the downstream side in the feed direction FD1 without being deviated to the right, between the front end portion 3F (see FIG. 5) of the regulation plate 3R and the front wall surface 1F (see FIG. 2) of the sheet storage portion 1. With this configuration, it is possible to prevent a skew from being generated between the regulation plates 3L, 3R and the guide portion 103A when a sheet S11 is fed from the sheet storage portion 1 to the guide portion 103A. In particular, since the first regulation levers 511L and 511R only hold the sheet S11 from left and right sides, it is possible to restrict a skew from being generated without stopping the sheet S11 between the pickup roller 21 and the conveyance roller 22.

Figure 9C:
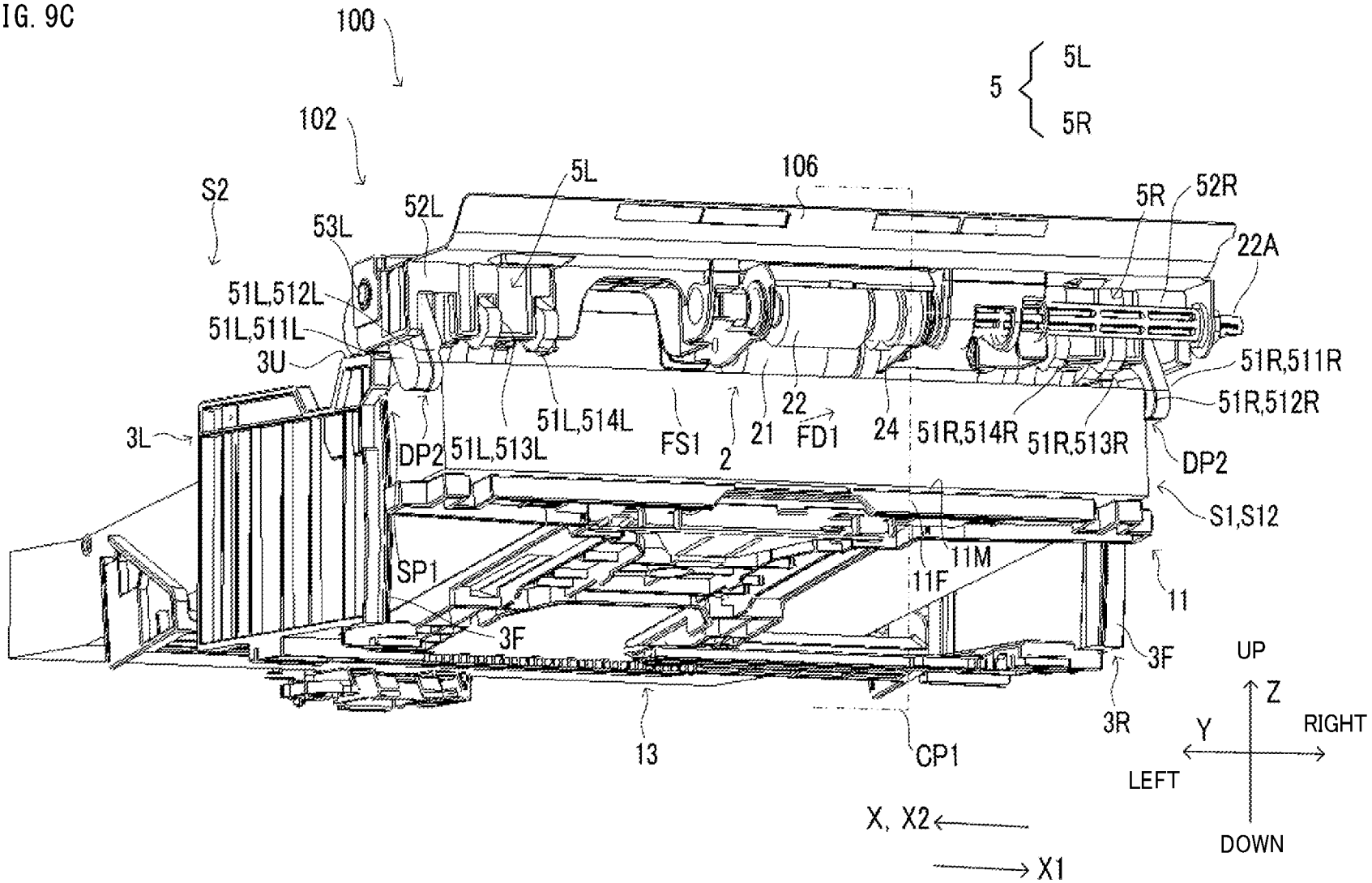
FIG. 9C is a diagram showing how the sheet feed device shown in FIG. 5 abuts on a sheet having a small size in a width direction Y, from opposite sides in the width direction Y.

Similarly, in a case where the regulation plates 3L and 3R regulate the position of the sheets S12 (see FIG. 3A), and the feed portion 2 feeds the sheets S12 one by one from the sheet storage portion 1 to the conveyance path 103, the second regulation levers 512L and 512R (see FIG. 5) abut on, from opposite sides in the width direction Y, a second portion DP2 of the sheets S12 that is on the downstream side of the specific portion SP1 of the sheets S12 in the feed direction FD1 when the sheets S12 are fed to the conveyance path 103, as shown in FIG. 9C. That is, the first arm portion 516L of the second regulation lever 512L is displaced from the first lower position H11 to the first upper position H21 where the first arm portion 516L abuts on the upper end portion 3U of the regulation plate 3L. In conjunction with this displacement, the second arm portion 517L of the second regulation lever 512L is displaced from the second upper position H12 to the second lower position H22. It is noted that in this case, the second lower position H22 is a position where the right side surface RS3 of the second arm portion 517L can abut on the first portion DP1 of the sheets S12. With this configuration, the second regulation levers 512L and 512R restrict a skew from being generated in a sheet S12 without stopping the sheet S12 between the pickup roller 21 and the conveyance roller 22.

In a case where the regulation plates 3L and 3R regulate the position of the sheets S13 (see FIG. 3B), the third regulation levers 513L and 513R (see FIG. 5) operate in the same manner as the second regulation levers 512L and 512R. In addition, when the regulation plates 3L and 3R regulate the position of the sheets S14 (see FIG. 3B), the fourth regulation levers 514L and 514R (see FIG. 5) operate in the same manner as the second regulation levers 512L and 512R. With this configuration, it is possible to restrict a skew from being generated in a sheet S13 or a sheet S14 without stopping the sheet between the pickup roller 21 and the conveyance roller 22.

As described above, in the sheet feed device 102, when, for example, the regulation plate 3L regulates the position of the sheets S11, the first regulation lever 511L faces the regulation plate 3L, and prevents a skew from being generated in the sheet S11 fed to the conveyance path 103. In this case, the second, the third, and the fourth regulation levers 512L, 513L, and 514L are disposed closer to the center line CL1 of the sheets S11 in the width direction Y than the first regulation lever 511L. The second, the third, and the fourth regulation levers 512L, 513L, and 514L further function as follows when the regulation plates 3L and 3R regulate the position of the sheets S11.

Figure 10:
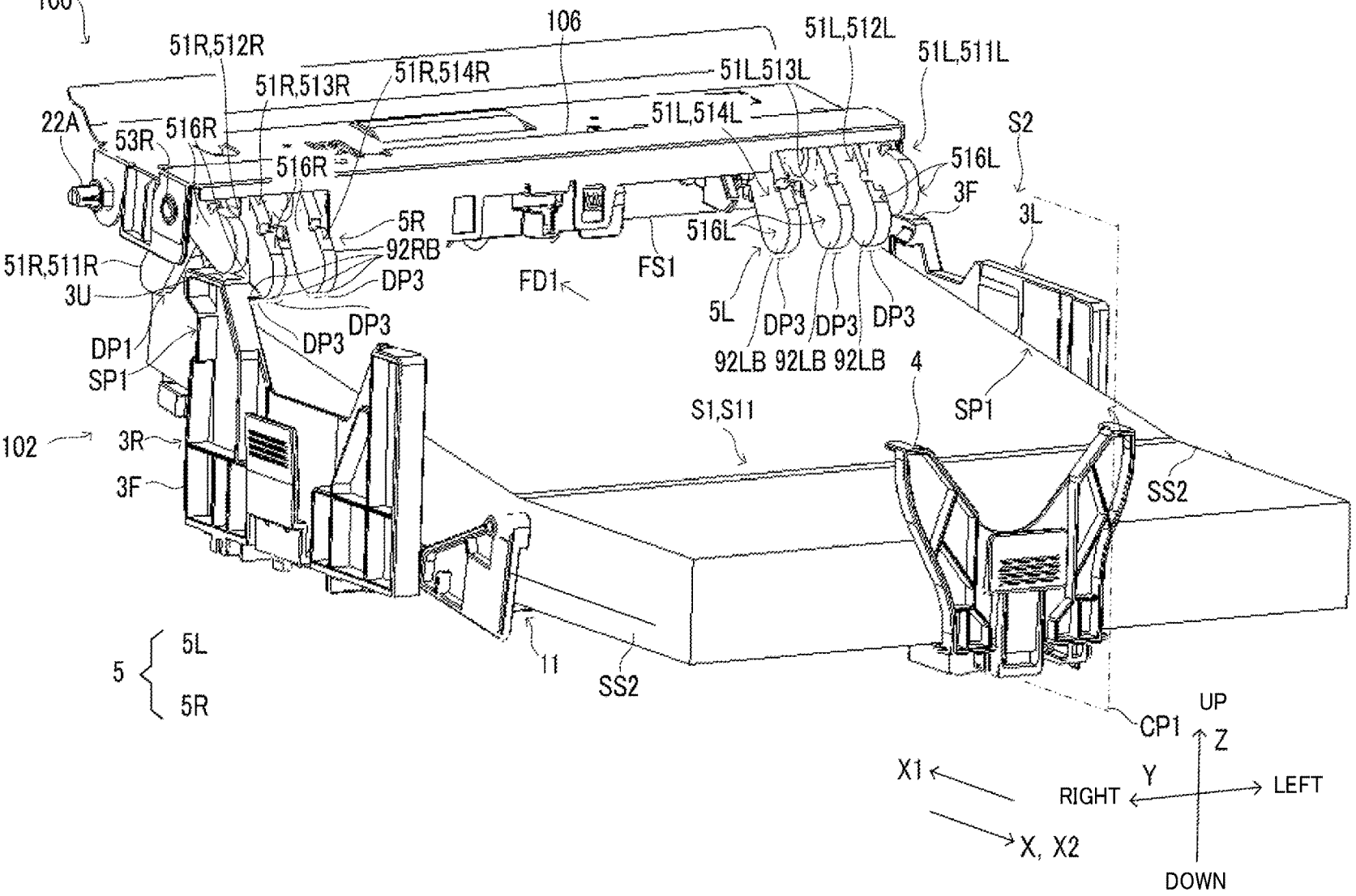
FIG. 10 is a diagram showing how the sheet feed device shown in FIG. 5 abuts on third portions of the sheets that are close to the opposite ends of the sheet in the width direction Y.

That is, as shown in FIG. 10, during the process where the regulation plate 3L is moved in the insertion direction X2 to the specific position P3 (see FIG. 9B), third portions DP3 of the top sheet S11 abut on the lower end portions 93LB of the second arm portions 517L of the second, the third, and the fourth regulation levers 512L, 513L, and 514L. As shown in FIG. 10, a portion of the top sheet S11 at the left side of the center plane CP1 abuts on the lower end portions 92LB of the first arm portions 516L of the second, the third, and the fourth regulation levers 512L, 513L, and 514L. As a result, when the sheets S11 are moved to the specific position P3 in a state where the regulation plates 3L and 3R regulate the position of the sheets S11, the first arm portions 516L of the second, the third, and the fourth regulation levers 512L, 513L, and 514L, and the first arm portions 516R of the second, the third, and the fourth regulation levers 512R, 513R, and 514R abut on, from above, the third portions DP3 (the oval portions represented by the two-dot chain line) that are close to opposite ends of the sheets S11 in the width direction Y and close to the leading end of the sheets S11 in the feed direction FD1.

Figure 11:
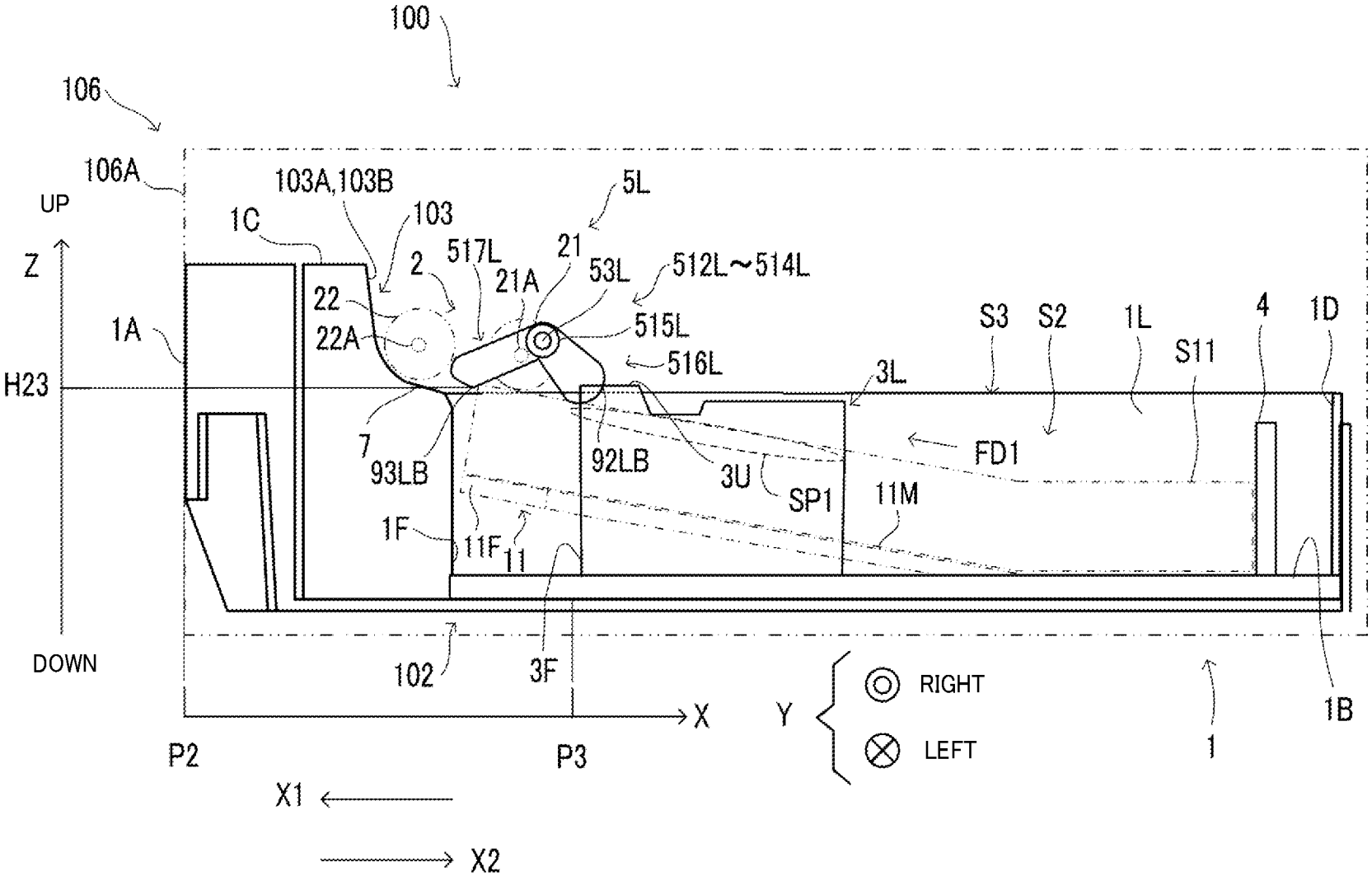
FIG. 11 is a schematic diagram showing a guide position H23 of the second arm portion shown in FIG. 7A and FIG. 7B.

When the sheets S11 abut on the lower end portions 93LB of the second arm portions 517L of the second, the third, and the fourth regulation levers 512L, 513L, and 514L, the base portions 515L of these levers start pivoting around the shaft 53L. In conjunction with the pivoting of the base portion 515L, as shown in FIG. 11, the lower end portions 93LB of the second arm portions 517L of the second, the third, and the fourth regulation levers 512L, 513L, and 514L are displaced from the second upper position H12 (see FIG. 9A) to a guide position H23 (see FIG. 11). The guide position H23 is, in the conveyance path 103, separated upward from a portion between the pickup roller 21 and the conveyance roller 22 by a specific distance. It is noted that the specific distance is determined by experiments or the like in the design development stage of the sheet feed device 102. Specifically, an appropriate distance is determined as the specific distance so that a flipping sound that is described below, can be restricted in a range where the second arm portions 517L do not interfere with the conveyance of the sheet S11.

It is supposed here that the second regulation levers 512L and 512R, the third regulation levers 513L and 513R, and the fourth regulation levers 514L and 514R do not abut on the third portions DP3 from above. The pickup roller 21 is disposed close to the center plane CP1 in the width direction Y. While the top sheet S1 is conveyed in the feed direction FD1 by the pickup roller 21 as such, the third portions DP3 (see FIG. 10) of the sheets S11 sway up and down.

When the top sheet S11 passes the pickup roller 21, the rear end thereof in the feed direction FD1 is flicked by the pickup roller 21, collides with the front wall surface 1F, and generates a sound (hereinafter, the sound is referred to as a "flipping sound"). The flipping sound is increased by the swaying of the third portions DP3.

On the other hand, when the regulation plates 3L and 3R regulate the position of the sheets S11, the first arm portions 516L of the second, the third, and the fourth regulation levers 512L, 513L, and 514L abut on the third portions DP3 of the sheets S11, and the second arm portions 517L of these levers are disposed at the guide position H23. With this configuration, when the top sheet S11 passes the pickup roller 21, the rear end thereof in the feed direction FD1 is prevented from being flicked. In addition, the second arm portions 517L and 517R restrict the rear end of the sheet S11 from swaying. As a result, even when the rear end of the top sheet S11 collides with the front wall surface 1F, it is possible to restrict a large flipping sound from being generated.

It is noted that when the second regulation levers 512L and 512R, the third regulation levers 513L and 513R, and the fourth regulation levers 514L and 514R are not aimed to restrict the flipping sound, the second arm portions 517L and 517R of the levers may not be displaced from the second upper position H12 to the guide position H23. In addition, the first arm portions 516L and 516R of the second regulation levers 512L and 512R, the third regulation levers 513L and 513R, and the fourth regulation levers 514L and 514R may be retreated to a place above the third portions DP3 close to the opposite ends of the sheet S11 in the width direction Y.

In addition, when the regulation plates 3L and 3R regulate the position of the sheets S12, the third regulation levers 513L and 513R and the fourth regulation levers 514L and 514R restrict the flipping sound of the sheets S12.

In the sheet feed device 102, the regulation levers 51L and 51R are displaced by a movement of the regulation plates 3L and 3R when the sheet storage portion 1 is pushed in, in the insertion direction X2. This eliminates the need to newly add an actuator for displacing the regulation levers 51L and 51R, to the image forming apparatus 100.

It is noted that although the image forming apparatus 100 generates prints by the electrophotographic method, the image forming apparatus 100 may generate the prints by the inkjet method.

The image forming apparatus 100 includes the first regulation portion 3 of the center registration method (see FIG. 3A). However, the image forming apparatus 100 may regulate, in the width direction Y, the position of the sheets S1 stacked on the sheet placing member 11, by what is called a side registration method. In the side registration method, the regulation plate 3L is moved in the width direction Y while the regulation plate 3R is fixed, or the regulation plate 3R is moved in the width direction Y while the regulation plate 3L is fixed.

In a case where the side registration method is adopted in the image forming apparatus 100, and the regulation plate 3L or the regulation plate 3R is moved in the width direction Y, the sheet feed device 102 only needs to include the left second regulation portion 5L or the right second regulation portion 5R.

In the embodiment described above, in the left second regulation portion 5L and the right second regulation portion 5R, the first regulation levers 511L and 511R may not be able to pivot around the shaft 53L. Specifically, in the first regulation lever 511L, the first arm portion 516L may include a lower end portion 92LB that extends from a corresponding base portion 515L to the upstream side in the feed direction FD1, and is disposed fixed to the first upper position H21. In addition, the second arm portion 517L may include a lower end portion 93LB that extends from a corresponding base portion 515L to the downstream side in the feed direction FD1, and is disposed fixed to the second lower position H22.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

a sheet storage portion which is attached to an apparatus main body in a detachable manner and in which a sheet is stored;

a first regulation portion standing on a bottom surface of the sheet storage portion and configured to regulate a position of the sheet in a predetermined width direction by externally abutting on a first side of the sheet in the width direction;

a feed portion provided in the apparatus main body and configured to feed the sheet in a feed direction perpendicular to the width direction; and a second regulation portion provided in the apparatus main body and configured to regulate a position of the sheet in the width direction by externally abutting on the first side of the sheet in the width direction at a downstream of the first regulation portion in the feed direction, the second regulation portion including:

a shaft extending in the width direction; and at least one regulation lever supported in such a way as to pivot around the shaft, wherein the at least one regulation lever includes:

a base portion through which the shaft is inserted;

a first arm portion inclined diagonally downward from the base portion toward an upstream in the feed direction to face the first regulation portion; and a second arm portion inclined diagonally downward from the base portion toward a downstream in the feed direction, and configured to be displaced from an upper position to a lower position, the upper position being higher than the upper end of the first regulation portion, the lower position being lower than the upper position, wherein when the second arm portion is located at the lower position, the second arm portion externally abuts on the first side of the sheet in the width direction, and when the sheet storage portion is attached to the apparatus main body, the first arm portion pivots upward around the shaft by abutting on the first regulation portion, and due to pivoting of the first arm portion, the second arm portion is displaced from the upper position to the lower position.

2. The sheet feed device according to claim 1, wherein the first regulation portion is configured to move in the width direction so as to regulate positions, in the width direction, of sheets of a plurality of types that have different sizes in the width direction, at a plurality of predetermined regulation positions, the second regulation portion includes a plurality of regulation levers, and the plurality of regulation levers are disposed at facing positions to face the plurality of predetermined regulation positions respectively, and one of the plurality of regulation levers facing the first regulation portion which is positioned at any one of the plurality of predetermined regulation positions, externally abuts on, in the width direction, the first side of the sheet that is regulated by the first regulation portion.

3. The sheet feed device according to claim 2, wherein the feed portion includes:

a pickup roller configured to feed the sheet stored in the sheet storage portion, in the feed direction by rotating while abutting on the sheet; and a feed roller disposed at a downstream of the pickup roller in the feed direction, and configured to convey the sheet by rotating while abutting on the sheet, in one of the plurality of regulation levers that is disposed closer to a center of the sheet in the width direction than another one of the plurality of regulation levers that faces the first regulation lever, the first arm portion pivots upward by abutting on a top surface of the sheet stored in the sheet storage portion, and due to pivoting of the first arm portion, the second arm portion is displaced from the upper position to a guide position, and the guide position is between the pickup roller and the feed roller, and is upward from a tangential line that passes an outer peripheral surface of the pickup roller and an outer peripheral surface of the feed roller.

4. The sheet feed device according to claim 1, wherein the first regulation portion includes a pair of regulation plates configured to regulate the position of the sheet in the width direction by abutting on, from opposite sides of the width direction, the first side and a second side of the sheet in the width direction, the second side facing the first side, and the second regulation portion includes a pair of regulation levers disposed to face the pair of regulation plates, and configured to regulate the position of the sheet in the width direction by abutting on the first side and the second side of the sheet from the opposite sides of the width direction.

5. An image forming apparatus comprising:

the sheet feed device according to claim 1; and an image forming portion configured to form an image on the sheet fed by the sheet feed device.

* * * * *